United States Patent [19]

Harase et al.

[11] 4,394,188

[45] Jul. 19, 1983

[54] PROCESS FOR PRODUCING FERRITE STAINLESS STEEL SHEETS HAVING EXCELLENT WORKABILITY

[75] Inventors: Jirou Harase, Munakata; Tadashi Nakayama, Kitakyushu, both of Japan

[73] Assignee: Nippon Steel Corporation, Tokyo, Japan

[21] Appl. No.: 290,713

[22] Filed: Aug. 6, 1981

[30] Foreign Application Priority Data

Aug. 9, 1980 [JP] Japan ..... 55-108813

[51] Int. Cl.[3] ..... C21D 8/04

[52] U.S. Cl. ..... 148/12 EA; 148/37

[58] Field of Search ..... 148/12 E, 12 EA, 37; 75/126 D, 126 J, 124

[56] References Cited

U.S. PATENT DOCUMENTS

| | | | |
|---|---|---|---|
| 3,067,072 | 12/1962 | Leffingwell et al. | 148/12 EA |
| 3,607,246 | 9/1971 | Kalita | 75/126 D |
| 3,850,703 | 11/1974 | Kalita | 148/12 EA |
| 3,997,373 | 12/1976 | Kazeva | 148/37 |

FOREIGN PATENT DOCUMENTS

| | | | |
|---|---|---|---|
| 52-5616 | 1/1977 | Japan | 148/12 EA |

*Primary Examiner*—Peter K. Skiff

*Attorney, Agent, or Firm*—Cushman, Darby & Cushman

[57] ABSTRACT

Process for producing a ferrite stainless steel having excellent workability, comprising hot rolling a ferrite stainless steel slab with a total reduction of at least 80% in a temperature range of from 1150° C. to 900° C. at the central portion of the slab thickness, and, without annealing the hot rolled sheet, cold rolling the hot rolled sheet by a single step into a final thickness.

3 Claims, 7 Drawing Figures

PROCESS FOR PRODUCING FERRITE STAINLESS STEEL SHEETS HAVING EXCELLENT WORKABILITY

BACKGROUND OF THE INVENTION

1. Field of the Invention:

The present invention relates to a process for production of ferrite stainless steel sheets of thin guage, particularly ferrite stainless steel sheets having excellent workability with simplified production procedures.

2. Description of the Prior Art:

The conventional production process for ferrite stainless steel sheets, for example, SUS430 series comprises box annealing a hot rolled steel strip for 2 hours or longer at a temperature ranging from 800° to 850° C., or continuous annealing for a short period of time at a temperature ranging from 900° to 1100° C., cold rolling the annealed steel strip and final annealing. The technical significance of the annealing of hot rolled steel strips in the conventional art is that: (1) it can reduce the problem of ridging which usually occurs during the press forming of the sheet; (2) it can improve the deep-drawability of the sheet (the deep-drawability is commonly represented by $\bar{r}$, and 1.0 or larger of $\bar{r}$ represents satisfactory deep-drawability); and (3) it can improve cold workability (the ferrite stainless steel "as-hot-rolled" is very hard and very difficult to perform cold rolling.).

Therefore, in the conventional arts of production of ferrite stainless steel sheets, the annealing of the hot rolled sheet has long been considered to be essential.

SUMMARY OF THE INVENTION

The present invention has been completed by discovery of techniques for eliminating the necessity of annealing of hot rolled steel sheets.

Regarding the ridging problem, it has been found by the present inventors that a similar or better improvement of the ridging property as compared with the conventional art can be obtained when the hot rolling is performed under such a condition that the total reduction in a temperature range of from 1150° to 900° C. is 80% or larger without a subsequent annealing. In the conventional arts, the annealing of hot rolled steel material is to destroy, through recrystallization, the <110>//RD texture which is formed during the hot rolling. Therefore, as taught by a prior art disclosed by Japanese Patent Publication No. Sho 45-34016, in which the finishing hot rolling is done with a reduction with at least 50% at relatively low temperatures, the restoration or recrystallization of the grains during the hot rolling is delayed so as to increase strain accumulation prior to the annealing of the hot rolling material, thereby promoting the static recrystallization during the annealing.

The present inventors have made studies and experiments on the recrystallization in ferrite stainless steels during hot rolling and the ridging in the final products, and found the following facts in the relation between the recrystallization behaviour and the ridging. Thus, it has been found that when the steel is hot rolled with a total reduction of at least 80%, more preferably at least 90%, with at least 35% reduction being performed by one or more passes, in a temperature range of from 900° to 1150° C., preferably from 1000° to 1100° C., an excellent ridging property can be obtained even without the annealing step subsequent to the hot rolling.

The present invention will be described in more details with reference to the attached drawings.

BRIEF DESCRIPTION OF THE DRAWINGS

FIG. 4(*b*) shows the relation between the starting temperature of hot rolling and the ridging property.

DETAILED DESCRIPTION OF THE INVENTION

Figure 1:
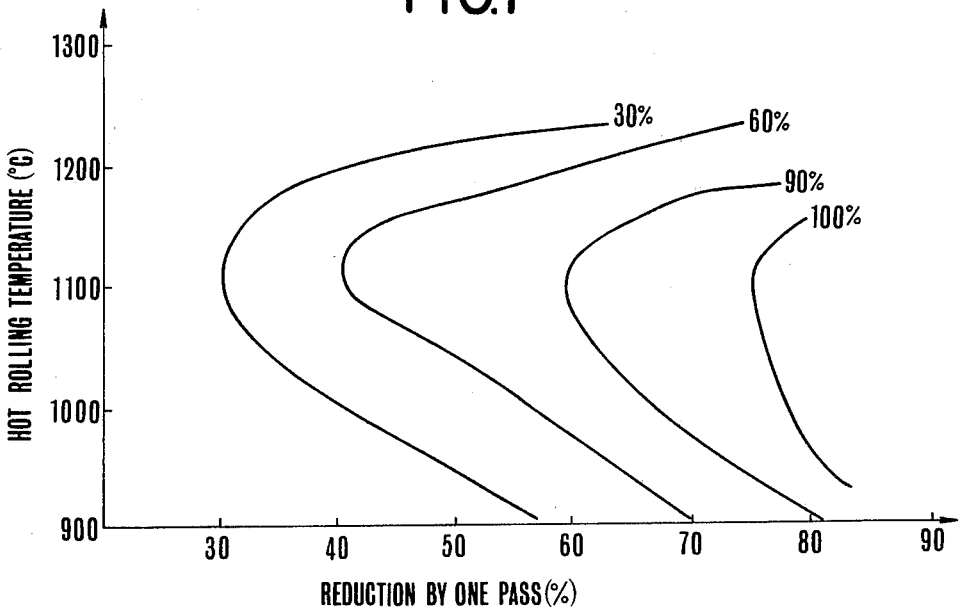
FIG. 1 shows the relation between the hot rolling temperature and reduction by one pass rolling and the recrystallization rate during the hot rolling (sample: SUS 430 stainless steel). The percent in the figure represents the recrystallization area ratio.
Figure 2:
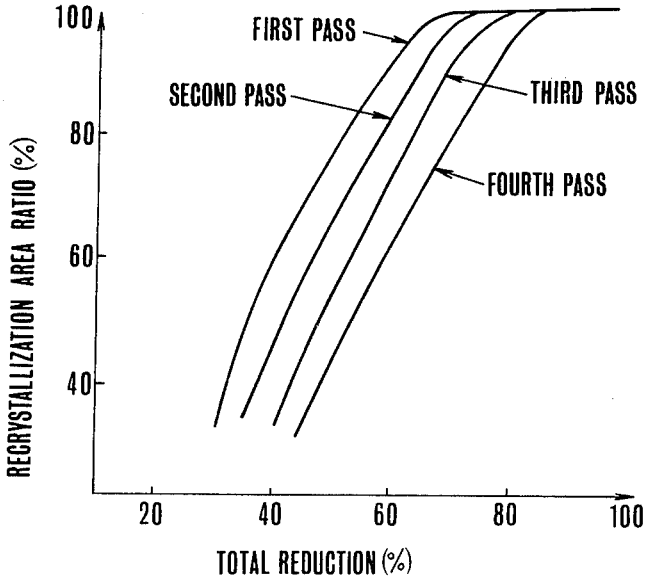
FIG. 2 shows the relation between the recrystallization area ratio and the total reduction in a multiple-pass hot rolling at 1100° C. (sample: SUS 430 stainless steel).

As shown in FIG. 1, when the hot rolling is performed in the temperature range of from 900° to 1150° C. with reduction of 80% or larger by one pass the steel is recrystallized and refined during the hot rolling, and as shown in FIG. 2, when the hot rolling is performed stepwisely by plural passes, the tendency is that the recrystallization becomes less apt to take place, but as the total reduction increases the recrystallization is more easily caused and a total reduction of at least 90% or higher will produce almost 100% recrystallization. It has been further discovered that when the total reduction is 80% or larger and at least one pass, preferably in the last half of the rolling schedule, performs 35% or larger reduction, the recrystallization is promoted and similarly excellent ridging property can be obtained without a subsequent annealing. It has been also found that if the recrystallization is caused under the same condition, a lower hot rolling temperature will give a finer recrystallized grain during the hot rolling, thus further improving the ridging property.

Meanwhile, when the hot rolling temperature is lower than 900° C., no satisfactory recrystallization is caused, and on the other hand, when the temperature is above 1150° C., satisfactory recrystallization can be caused, but the recrystallized grains are too coarse to obtain an adequate ridging property.

Next, regarding the $\bar{r}$ value which is an index of the deep-drawability, it has been found by the present inventors that the $\bar{r}$ value has a close corelation with the amount of AlN precipitation in the hot rolled steel sheets under the as-rolled condition, specifically the amount of N as AlN, and a larger amount of N as AlN will give a higher $\bar{r}$ value. For example, a hot rolled steel sheet with 30 ppm N as AlN will give a $\bar{r}$ value of 1.0, a similar sheet with 50 ppm N as AlN will give a $\bar{r}$ value of 1.2, and a similar sheet with 65 ppm N as AlN will give a $\bar{r}$ value of 1.4. In the conventional arts where the hot rolled steel sheet is subsequently annealed, when the steel contains Al, the annealing will precipitate AlN to increase the $\bar{r}$ value. In this case, however, the r value in the direction with an angle 45° with respect to the rolling direction shows the lowest value, while in the present invention the r value in the same direction shows the highest value. Therefore, the mechanism of improving the $\bar{r}$ value in the present invention is completely different from the conventional arts.

In order to maintain the AlN precipitates in the hot rolled steel sheet under the as-hot-rolled condition, the AlN may be precipitated prior to the start of hot rolling or may be precipitated during the hot rolling or in the coiling step after the completion of hot rolling. When the AlN is precipitated prior to the start of hot rolling, it is preferable the heating temperature is not higher than 1200° C., because the AlN will be almost completely dissolved in solid solution at 1200° C. The amount of the AlN precipitation varies depending on the contents of Al, N and C in the steel. For example, if the slab heating temperature is defined to 1100° C., it is possible to assure 30 ppm or larger N as AlN precipitation during the slab heating when the slab contains 70 to 150 ppm N, 0.04 to 0.07% C. and not lower than 0.08% Al. However, in the present invention, the slab may contain not less than 70 ppm N, preferably 70 to 220 ppm N and 0.03 to 0.1% C., preferably 0.04 to 0.08% C. As stated just before, it is possible to precipitate the AlN during the hot rolling. However, when the rolling is performed in a continuous hot rolling mill composed of rough rolling stands and finishing rolling stands, the finishing rolling finishes in several ten seconds, so that it is difficult to effect the precipitation during the short time of finishing rolling. In such a case, the precipitation may be effected during the rough rolling or during the transient stage from the rough rolling to the finishing rolling. As the precipitation nose of AlN appears near 800° C., it is possible to effect the AlN pecipitation during the cold rolling after the coiling, if the hot rolled strip is coiled at a temperature not lower than 800° C. and protected with a cover etc. so as to avoid the temperature lowering of the hot rolled strip after the coiling.

Figure 3:
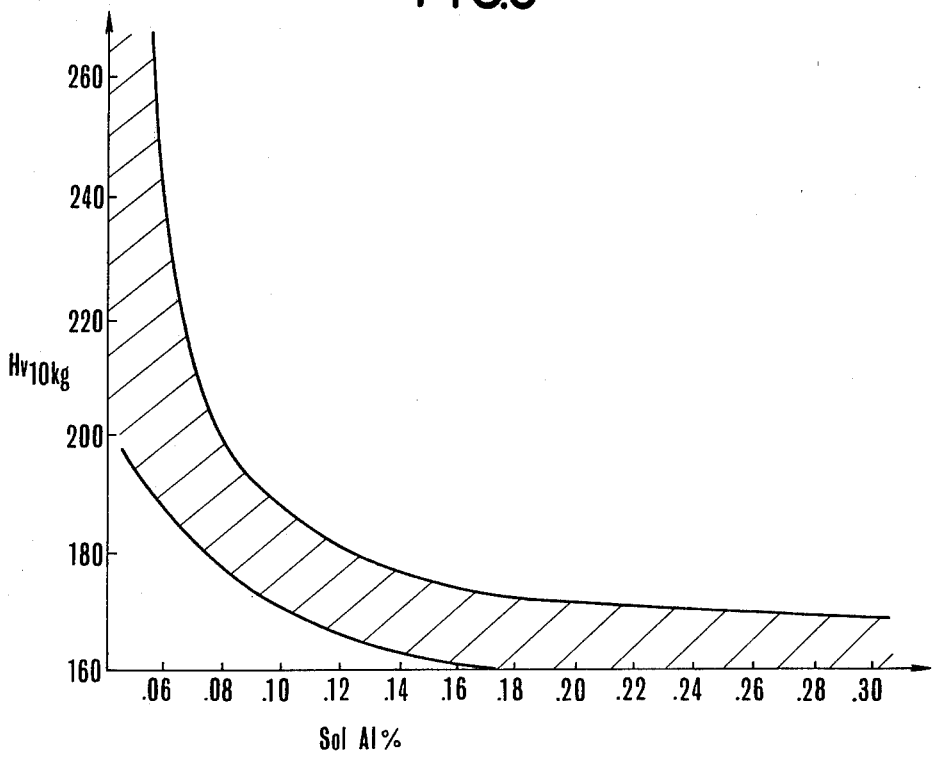
FIG. 3 shows the relation between the hardness under the as-hot-rolled condition and the sol.Al content in the hot rolled steel sheet.
Figure 4B:
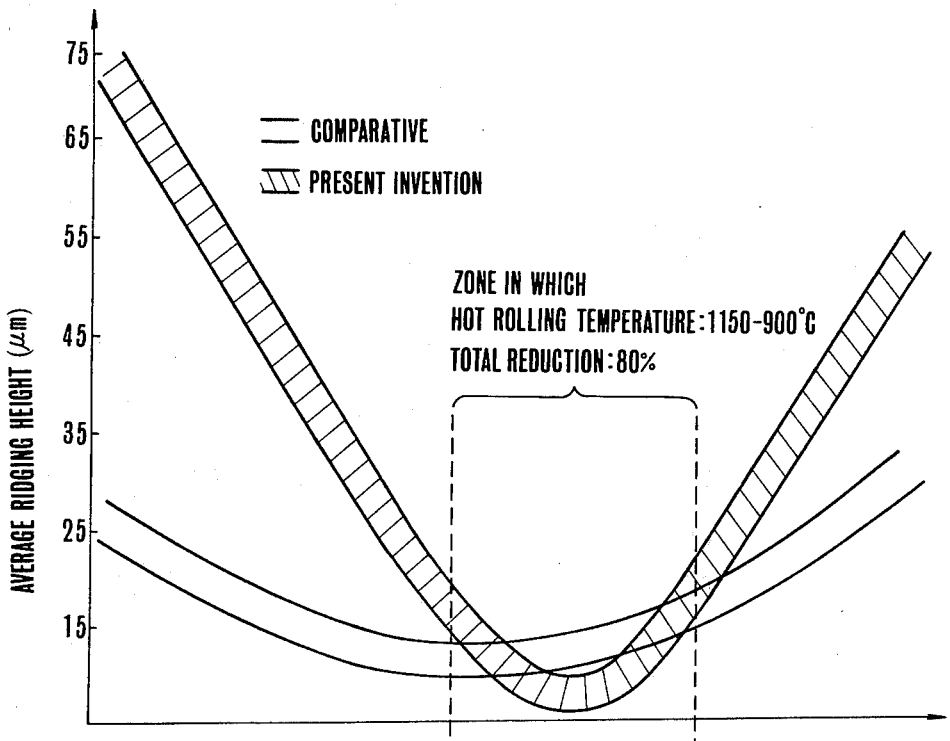
FIG. 4(*a*) shows the relation between the starting temperature of hot rolling and the material temperature after three passes of rolling (total reduction: 80%).
Figure 4A:
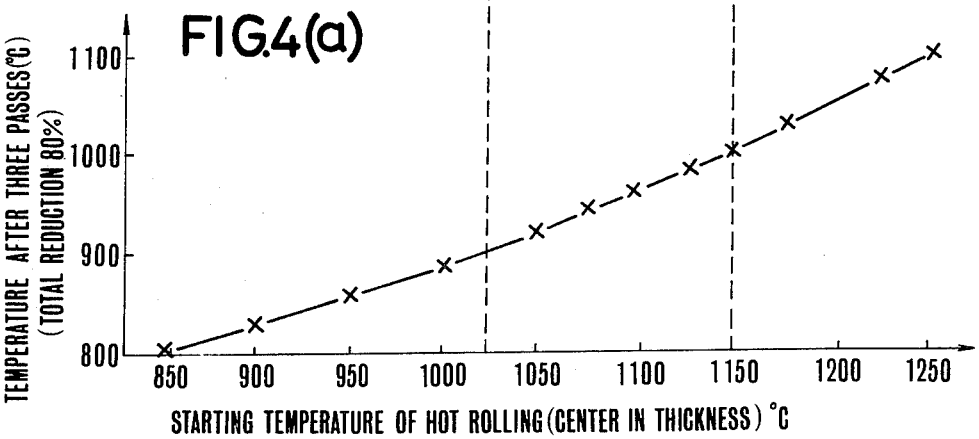

Lastly, the material hardness as cold rolling property before the cold rolling, recent cold rolling techniques have made it possible to cold roll a material having a high degree of hardness under the as-hot-rolled condition. However, it has been found by the present inventors that when 0.08% or larger of sol.Al is added to the steel, similar softening effects can be attained as when the hot rolled steel is annealed, as shown in FIG. 3. However, even when sol.Al is added in amounts more than 0.5% no substantial additional effect can be obtained. Therefore, the upper limit of the sol.Al addition is set at 0.5% in the present invention.

The mechanism of softening of the hot rolled steel material by addition of Al has not been clarified, but it is assumed that the addition of Al may accelerate the $\gamma \rightarrow \alpha$ transformation during hot rolling resulting in the prevention of the formation of hard phases, such as martensite, which exist commonly in the conventional SUS 430 hot rolled strip. According to the present invention, as described hereinbefore, the grain size prior to the start of hot rolling is made as small as possible, the recrystallization is caused during the hot rolling, and the hot rolling is performed at temperatures as low as possible as well as with as large reduction as possible to produce fine recrystallized grains. In this way, the ridging property can be improved even without annealing the hot rolled material, the $\bar{r}$ value can be improved by maintaining the required amount of AlN precipitation under the as-hot-rolled condition, and the cold workability can be improved by maintaining the content of sol.Al in certain amounts.

DESCRIPTION OF PREFERRED EMBODIMENTS

The present invention will be better understood from the following embodiments.

EXAMPLE 1

In order to determine effects of the slab heating temperature and the hot rolling temperature separately, test pieces of 25 mm in thickness, 70 mm in width and 100 mm in length were taken from a continuously cast steel slab of 180 mm in thickness having a chemical composition shown in Table 1, heated at 1350° C. for 30 minutes, and extracted into air. When the material temperature (at the central portion in thickness) reached various temperatures ranging from 1250° C. to 850° C., the test pieces were subjected to four pass hot rolling of →15 mm→9mm→5 mm→3.7 mm.

The relation between the material temperatures at the time when the total reduction reached 80% (after three passes, 5 mm in thickness) and the starting temperature of the hot rolling is shown in FIG. 3(*a*), in which the starting temperature range of from 1150° C. to 1025° C. is shown to provide a material temperature not lower than 900° C. after the total reduction of 80%, thus satisfying the hot rolling condition of the present invention. The hot rolled steel strips thus obtained were subjected to the following two cold rolling procedures to obtain final sheets of 0.7 mm in thickness.

Procedure 1 (Present invention):

Cold rolling (3.7 mm→0.7 mm)→continuous annealing (830° C.×2 minutes)

Procedure 2 (Comparative):

Box annealing (850° C.×6 hours)→cold rolling (3.7 mm→0.7 mm)→continuous annealing (830° C.×2 minutes)

As shown in FIG. 3(*b*), when the hot rolling is performed with a total reduction of 80% in a temperature range of from 900° to 1150° C., a similar or better ridging property can be obtained as compared with the conventional arts in which the hot rolled material is annealed.

The ridging property is evaluated by the surface roughness produced when 16% tension strain is given to test pieces (JIS No.5) taken in the rolling direction.

The general tendency of high ridging values in this example is due to the fact that the grains in the test pieces were caused to abnormally grow by the high temperature heating at 1350° C. Needless to say, this abnormal grain growth can be avoided if the heating temperature is maintained not higher than 1100° C., and therefore the ridging property may be generally improved.

TABLE 1

| Chemical Composition of Sample Slab (%) | | | | | |
|---|---|---|---|---|---|
| C | Si | Mn | Cr | N | sol.Al |
| 0.056 | 0.35 | 0.45 | 16.51 | 0.0110 | 0.067 |

EXAMPLE 2

SUS 430 stainless steel slabs of 200 mm in thickness having a chemical composition shown in Table 2 were heated at 1100° C. for 2 hours, and immediately hot rolled to 20 mm in thickness by a four-pass schedule of 30%, 36%, 52% and 55% (total reduction: 95.5%). The material temperature at the stage when the material was rolled to 20 mm was 1000° C., which was in the preferable range of the hot rolling condition according to the present invention. Then the materials were further subjected to seven-pass hot rolling to obtain hot rolled sheets of 3.7 mm in thickness. The analysis of these hot rolled sheets showed that N as AlN was in the range of from 5 ppm to 65 ppm as shown in Table 2. It is shown that when the sol.Al content is more than about 0.08%, the N as AlN content is 30 ppm or larger. Therefore, the N as AlN content and the sol.Al content are in a positive corelation to each other. The hot rolled sheets thus obtained were subjected to the following two procedures of cold rolling to obtain a final thickness of 0.7 mm.

Procedure 1 (Present invention):

Cold rolling (3.7 mm→0.7 mm)→continuous annealing (830° C.×2 minutes)

Procedure 2 (Comparative):

Box annealing (850° C.×6 hours)→cold rolling (3.7 mm→0.7 mm)→continuous annealing (830° C.×2 minutes)

Figure 5:
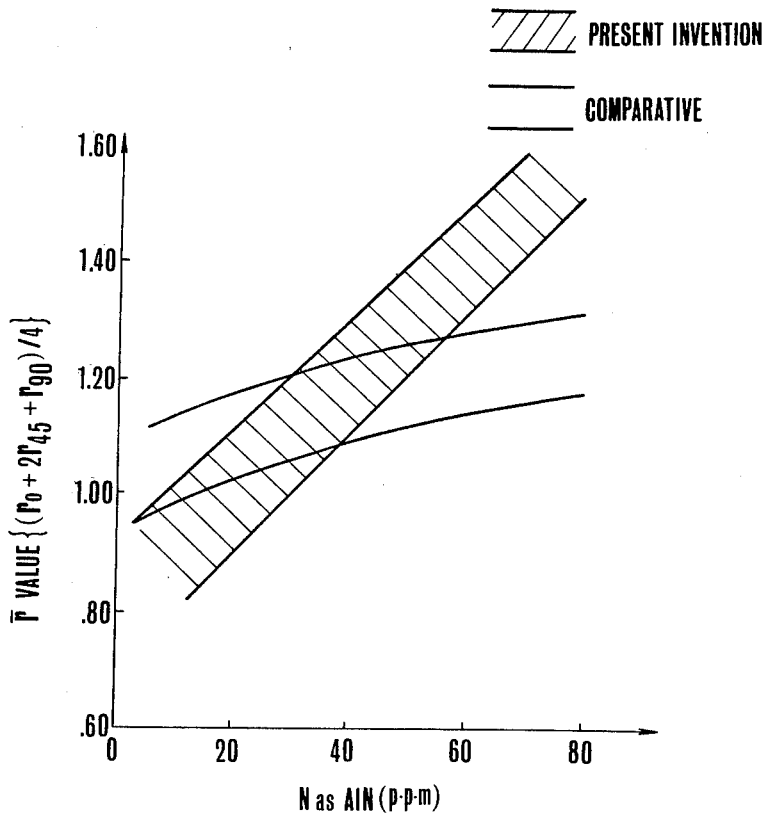
FIG. 5 shows the relation between the N as AlN content under the as-hot-rolled condition and the r value of final products.

The relation between $\bar{r}$ values of the cold rolled products thus obtained by the above procedures and the N as AlN contents in the hot rolled sheet is shown in FIG. 5.

As shown, in the case of the procedure according to the present invention, when the N as AlN content is 30 ppm or larger, the $\bar{r}$ value is 1.0 or higher, and when the N as AlN content is 65 ppm or larger, the $\bar{r}$ value is 1.40 or higher. While, in the case of the comparative procedure, the $\bar{r}$ value has no definite corelation with the analysis of N as AlN in the hot rolled sheet, and randomly varies from 1.0 to 1.30.

The $\bar{r}$ values in this example were determined by the following formula:

$$\bar{r}=(r_0+2r_{45}+r_{90})/4$$

where $R_0$ represents the r value in the direction at 0° to the rolling direction, $r_{45}$ represents the r value in the direction at 45° to the rolling direction, and $r_{90}$ represents the r value in the direction at 90° to the rolling direction.

When treated by the procedure according to the present invention, the $r_{45}$ value is the highest, while when treated by the comparative procedure, the $r_{45}$ value is the lowest. This indicates that the mechanism of the r value formation in the present invention is completely different from that in the comparative procedure.

TABLE 2

| Chemical Compositions of Sample Slabs and AlN Contents in Hot Rolled Sheets | | | | | | |
|---|---|---|---|---|---|---|
| Chemical Composition (weight %) | | | | | | N as AlN |
| C | Si | Mn | Cr | N | sol.Al | (p.p.m.) |
| 0.064 | 0.48 | 0.47 | 16.3 | 0.013 | 0.061 | 10 |
| 0.060 | 0.48 | 0.54 | 16.3 | 0.012 | 0.064 | 5 |
| 0.062 | 0.48 | 0.54 | 16.3 | 0.015 | 0.068 | 18 |
| 0.047 | 0.53 | 0.16 | 16.5 | 0.011 | 0.093 | 43 |
| 0.048 | 0.53 | 0.16 | 16.5 | 0.011 | 0.113 | 55 |
| 0.050 | 0.48 | 0.23 | 16.5 | 0.010 | 0.121 | 65 |

EXAMPLE 3

In order to investigate effects of reductions by individual passes in a multiple-pass rolling, continuously cast slabs of 200 mm in thickness having chemical compositions shown in Table 3 were heated at 1100° C. for 2 hours, and rolled to 25 mm by the following four types of rolling schedules.

(1) 5-pass hot rolling: 20%→27.7%→40%→40%→40% (total reduction=87.5%)

(2) 6-pass hot rolling: 20%→27.7%→35%→35%→35% (total reduction=87.5%)

(3) 6-pass hot rolling: 20%→31%→31%→31%→31%→31% (total reduction=87.5%)

(4) 7-pass hot rolling: 20%→28%→26%→26%→26.5%→26%→26% (total reduction=87.5%)

In all of the above cases, the material temperature at the time when the material was rolled to 25 mm was 950° C. All of the above rolling conditions with different reduction distributions are within the scope of the present invention (total reduction: not less than 80%, rolling temperature: 1100° C. to 950° C.).

The hot rolled materials for the procedure 1 of cold rolling according to the present invention were immediately subjected to finishing hot rolling with seven passes to obtain 3.7 mm hot rolled sheets, while the hot rolled materials for the comparative procedure 2 of cold rolling were left in air to be cooled to 850° C. and subjected to finishing hot rolling with seven passes to obtain 3.7 mm hot rolled sheets. These two groups of hot rolled steel sheets were respectively subjected to the procedures 1 and 2 set forth below to obtain 0.7 mm cold rolled sheets.

Procedure 1 (Present invention):

The material obtained by finishing rolling immediately after rough rolling was used Cold rolling (3.7 mm→0.7 mm)→continuous annealing (830° C.×2 minutes)

Procedure 2 (Comparative):

The material obtained by rough hot rolling, cooling in air to 850° C. and then finishing hot rolling was used Box annealing (850° C.×6 hours)→cold rolling (3.7 mm→0.7 mm)→continuous annealing (830°0 C.×2 minutes)

TABLE 3

| Chemical Compositions of Sample Slab (%) | | | | | |
|---|---|---|---|---|---|
| C | Si | Mn | Cr | N | sol.Al |
| 0.067 | 0.46 | 0.50 | 16.55 | 0.016 | 0.057 |

Figure 6:
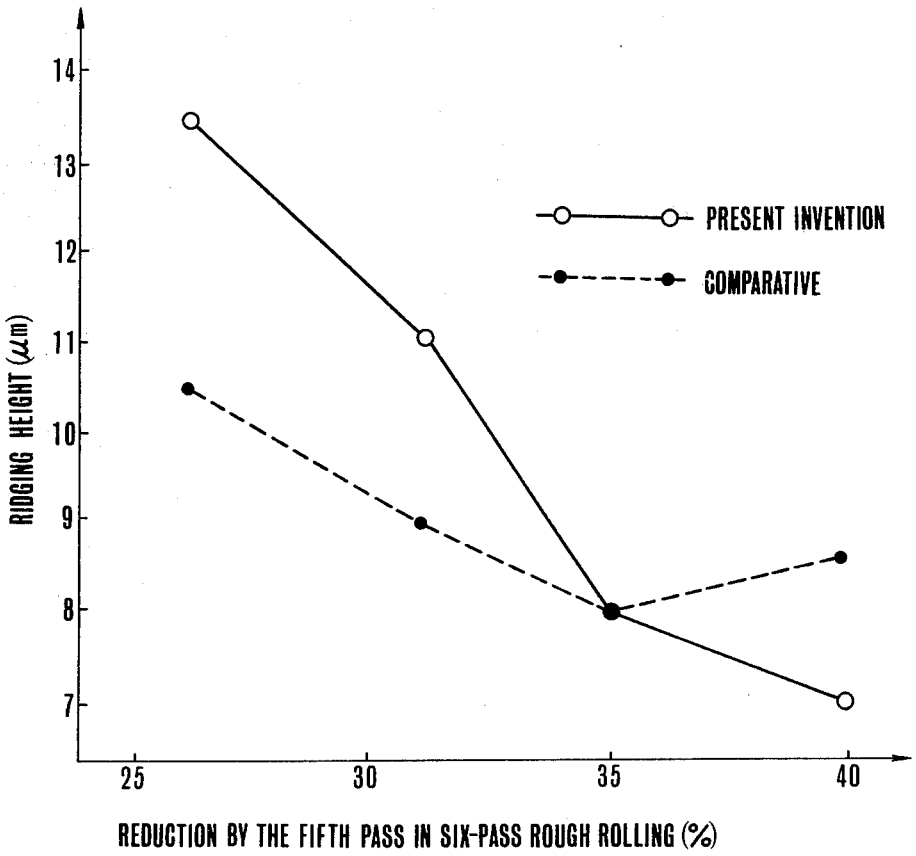
FIG. 6 shows the relation between the reduction by one pass in the last half of the rough rolling and the ridging height.

FIG. 6 shows the relation between the reduction distribution in the rough rolling and the ridging. In the case of the comparative procedure, as the strain restoration due to the finishing rolling temperature is large, the static recrystallization is promoted by the annealing of the hot rolled steel sheets so that the effect of the reduction distribution in the rough rolling is relatively small, while in the case of the procedure according to the present invention, a larger reduction by one pass can produce a better ridging property. In the conventional art as the finishing hot rolling is performed at relatively lower temperatures, increased loads are imposed on the rolling rolls, resulting in occurrence of the so-called scale damage on the surface of the hot rolled steel sheet. In the present invention, the finishing hot rolling is performed at relatively high temperatures, so that the load on the rolls is smaller, hence causing no scale damage, and resulting in a good surface quality.

As understood from the foregoing description of the present invention, ferrite stainless steels having good workability can be advantageously produced by the present invention.

What is claimed is:

1. A process for producing a SUS 430 type ferrite stainless steel sheet having excellent workability, comprising hot rolling a ferrite stainless steel slab containing 0.03 to 0.1% C, 0.08 to 0.5% sol. Al and not less than 70 ppm N with a total reduction of at least 80% in the temperature range from 1150° to 900° C. at the central portion of the slab thickness, reduction by at least one pass of the hot rolling being not less than 35%, coiling at a temperature not lower than 800° C. and, without subjecting the hot rolled steel sheet to annealing, cold rolling the hot rolled steel sheet by a single step into a final thickness.

2. Process according to claim 1, in which the hot rolled steel sheet under as-hot-rolled condition contains AlN in an amount not less than 30 ppm of N as AlN.

3. A process according to claim 1 wherein the ferrite stainless steel slab contains 70 to 220 ppm N.

* * * * *